US005591109A

United States Patent [19]

Strnad

[11] Patent Number: 5,591,109

[45] Date of Patent: Jan. 7, 1997

[54] QUICK-RELEASE RETAINING COLLAR ASSEMBLY FOR A BARBELL

[76] Inventor: George Strnad, 131 Lawton Rd., Riverside, Ill. 60546

[21] Appl. No.: 275,322

[22] Filed: Jul. 14, 1994

Related U.S. Application Data

[63] Continuation-in-part of Ser. No. 146,402, Nov. 1, 1993, abandoned, which is a continuation of Ser. No. 14,069, Feb. 5, 1993, abandoned, which is a continuation of Ser. No. 896,506, Jun. 2, 1992, abandoned, which is a continuation of Ser. No. 693,928, Apr. 29, 1991, abandoned.

[51] Int. Cl.[6] ..... A63B 21/075

[52] U.S. Cl. ..... 482/107; 24/524

[58] Field of Search ..... 482/107, 106; 24/24, 25, 19, 524, 270, 273, 528.5

[56] References Cited

U.S. PATENT DOCUMENTS

| | | | |
|---|---|---|---|
| 3,305,234 | 2/1967 | Cline et al. | 482/107 |
| 4,223,880 | 9/1980 | Brems | 269/101 |
| 4,646,398 | 3/1987 | Myhrman | 482/107 X |
| 5,242,568 | 9/1993 | Ehr et al. | 204/289 R |

FOREIGN PATENT DOCUMENTS

| | | | |
|---|---|---|---|
| 2186500 | 8/1987 | United Kingdom | 482/107 |

*Primary Examiner*—Richard J. Apley
*Assistant Examiner*—John Mulcahy
*Attorney, Agent, or Firm*—Dressler, Goldsmith, Milnamow & Katz, Ltd.

[57] ABSTRACT

A quick-release collar assembly for fastening weights onto a bar is disclosed. The assembly includes an annular collar defining a bore which enables the assembly to be slid onto the barbell and to snugly abut against the weights to be retained thereon. A lock shoe is disposed in a passage which communicates with the bore in the collar. A cam is provided which is reactive against the lock shoe and urges the lock shoe into retaining engagement with the bar when the cam is in a locked position. When the cam is in an unlocked position, a resilient spring acts to urge the lock shoe out of engagement with the bar, so that the collar can be easily removed from the bar.

The cam is pivotally supported on a pivot shaft which incorporates a resilient bushing which is compressed when the cam is moved to the locked position. In another embodiment, the cam is reactive directly against the bar.

7 Claims, 3 Drawing Sheets

QUICK-RELEASE RETAINING COLLAR ASSEMBLY FOR A BARBELL

CROSS-REFERENCE TO RELATED APPLICATIONS

This application is a continuation-in-part of application Ser. No. 08/146,402, filed 1 Nov. 1993, now abandoned which was a continuation of application Ser. No. 08/014,069, filed 5 Feb. 1993, now abandoned, which was a continuation of application Ser. No. 07/896,506, filed 2 Jun. 1992, now abandoned, which was a continuation of application Ser. No. 07/693,928, filed 29 Apr. 1991, now abandoned.

TECHNICAL FIELD

The present invention is directed to a collar assembly that retains weights on a bar which is easily and quickly removable.

BACKGROUND OF THE INVENTION

Weight lifting, in addition to being a sport unto itself, is practiced by a significant number of individuals training for a variety of different sports, as well as by those desiring to just generally stay in shape. Thus, people with a broad range of physical conditioning lift weights. Therefore, weights must be readily adjustable in order to be lifted by a variety of people at various levels of skill and conditioning.

Typically, adjustable free weights in the form of barbells are employed with a plurality of weights selectively placed on an associated bar and lifted. The weights are usually circular discs with a hole in the center thereof. A weight is placed on the bar by aligning the hole in the weight with the bar and sliding it onto the bar. Adjustability is provided by adding weights of the desired amount onto the bar.

Opposite end regions on the bar are configured for placing the weights thereon. A stop is provided on the end region of the bar to prevent the weights from sliding onto the central area of the bar that is gripped for lifting. After the desired weights are added onto the bar, a removable collar of some sort is positioned on the bar against the weights to secure them onto the bar as well as to keep them from shifting or otherwise moving as the bar is lifted and lowered.

Many types of collars have been developed to retain weights on a bar. These range from the very complex to the very simple. The more complex collars are generally required for retaining a greater amount of weight on the bar.

Simple collars, having a screw that can be tightened on the bar once the collar is placed snugly against the weights on the bar, are known in the art. These screw type collars are difficult to tighten by hand and have a tendency to dent or otherwise damage or deform the bar.

More complex collars typically include a coil spring-like resilient portion which can be expanded by pressing two handles together. The resilient portion, when expanded, slips over the bar and can be placed snugly against the weights. Once the handles are released, the resilient portion contracts around the bar, thereby gripping it. However, when a great amount of weight is desired to be retained on the bar, these resilient collars exert insufficient force to keep the weight in place.

Other collars which use a resilient member to clamp or otherwise lock a collar onto a bar are limited in their gripping strength, and do not adequately prevent heavy weights from moving or slipping on the bar. A flexible collar in which a downward force is applied to expand the collar while slipping it on the bar also has limited gripping strength.

A collar which requires deforming a portion of the collar to secure the collar onto the bar while urging the collar against the weights to be secured onto the bar requires precision in placing it on the bar. If this collar is placed too close to the weights, there is insufficient room for the collar to advance along the bar. If the collar is initially placed too far from the weights which it is to secure on the bar, the weights are not snugly retained on the bar and can spin, wobble or slide. Since balance is a critical aspect of lifting weights, weights that spin or wobble on the bar can detract from stability and control during lifting.

SUMMARY OF THE INVENTION

The present invention contemplates a quick release retaining collar assembly for a barbell. A quick release collar assembly in accordance with the present invention is easy to use and can retain even heavy weights on the bar snugly so that the weights do not significantly wobble when the bar is lifted. To this end, a quick release collar assembly incorporating the present invention includes an overcenter locking mechanism which facilitates secure, yet readily removable attachment of the collar assembly to the bar of the barbell.

A quick release collar assembly incorporating the present invention includes a collar that defines an axial bore to receive a bar when the collar is slipped onto the bar. The collar includes an opening or discontinuity therein to allow a portion of a locking assembly to engage a weight bar on which the collar is received for retaining the collar in place and to retain weights on the bar in position.

In one embodiment of a quick release collar assembly incorporating the present invention the opening may take the form of a passage oriented transverse to the bore which communicates with the axial bore therein. A lock shoe is disposed in the passage. The lock shoe moves in the passage so that it can engage and disengage the bar. The collar also has a lever-like cam which urges the lock shoe into engagement with the bar when the cam is in a locked position to securely retain the collar on the bar.

A resilient spring or like member is positioned in the passage, and urges the lock shoe away from the bar when the cam is in an unlocked position. The spring keeps the lock shoe away from the bar when the cam is in the unlocked position, which allows the collar to be easily removed from the bar. The relationship between the spring and the lock shoe is such that the spring is held captive in the passage by the lock shoe.

The relationship between the passage axis and the bore axis is such that they intersect. Typically the passage axis is perpendicular to the bore axis. The cam is preferably an overcenter cam so that the collar resists movement in the locked position. The over- center cam acts to retain the collar on the bar when a force which urges the collar off of the bar is applied to the collar when locked onto the bar.

The collar may take the form of a generally cylindrical body having an enlarged weight retaining flange at one end thereof and an opening formed in the body thereof intermediate its ends. A pivot support structure disposed adjacent the opening pivotally supports a locking assembly for engagement with a bar on which the collar is located for retaining the collar in place.

The locking assembly may take the form of an over center locking cam arm pivotally supported on a pivot shaft engaged with the pivot support structure for rotation into a locking position. The pivot shaft incorporates a resilient bushing to facilitate movement of the locking cam arm into the locking position in engagement with the weight bar. The locking cam arm includes an off center projecting portion which passes through the opening as the locking arm is rotated into the locking position to engage the surface of the weight rod. In the closed or locking position of the locking cam arm, a detent in the surface of the offset cam portion engages the curved, convex surface of the weight rod to retain the arm in the locking position.

The cam portion may be shaped to minimize engagement with the weight rod during the early portion of the rotation of the arm into the locking position. The resilient bushing compresses as the portion of the cam of maximum dimension moves past the surface of the bar without undue resistance into the locking position, and also allows the collar to be used with weight bars having variations in diameter. Bushings of different sizes and hardness may be appropriate to accommodate different variations in bar dimension.

Numerous other advantages and features of the present invention will become readily apparent from the following detailed description of the invention and the disclosed embodiments thereof, from the claims, and from the accompanying drawings in which the details of the invention are fully and completely disclosed as a part of this specification.

DESCRIPTION OF THE PREFERRED EMBODIMENT

Figure 1:
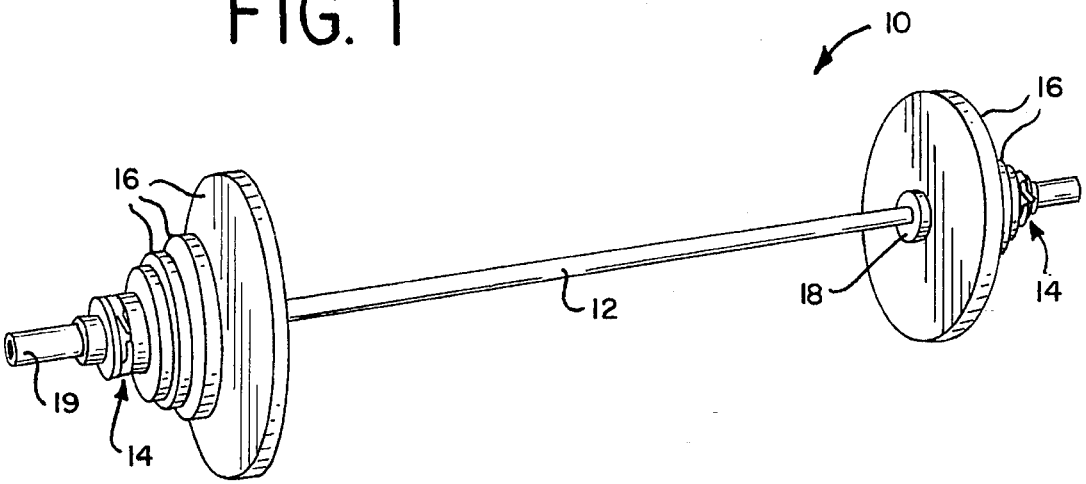
FIG. 1 is a perspective view of a barbell with weights thereon which are retained on the bar by a collar assembly embodying the principles of the present invention.

While the present invention is susceptible of embodiments in various forms, there is shown in the drawings and will hereinafter be described presently preferred embodiments thereof, with the understanding that the present disclosure is to be considered as an exemplification of the principles of the invention, and is not intended to limit the invention to the specific embodiments illustrated.

The present invention contemplates a collar assembly such as for barbells for retaining weights on a bar. The collar assembly can be easily placed on the bar or removed therefrom. The assembly includes a collar equipped with a cam which has a locked and an unlocked position. The cam can be easily manipulated from its unlocked position to its locked position, or vice-versa, without the use of tools. The force necessary to manipulate the cam is not great. The collar slides easily on the bar when the cam is in the unlocked position because the mechanism which engages the bar when the cam is in the locked position is retracted when the cam is in the unlocked position.

FIG. 1 illustrates a barbell assembly 10 which has a bar 12 with a collar assembly 14 embodying the present invention thereon to retain weights 16 on the bar. The collar assembly retains the weights 16 in position against a stop 18 which is affixed to the bar. As shown in FIG. 1, each of the stops 18 may be formed as part of the sleeve 19 rotatably received over the ends of the bar 12, as is well known. When a sleeve is used, the weights 16 and the collar 14 slide over the sleeve.

Figure 2:
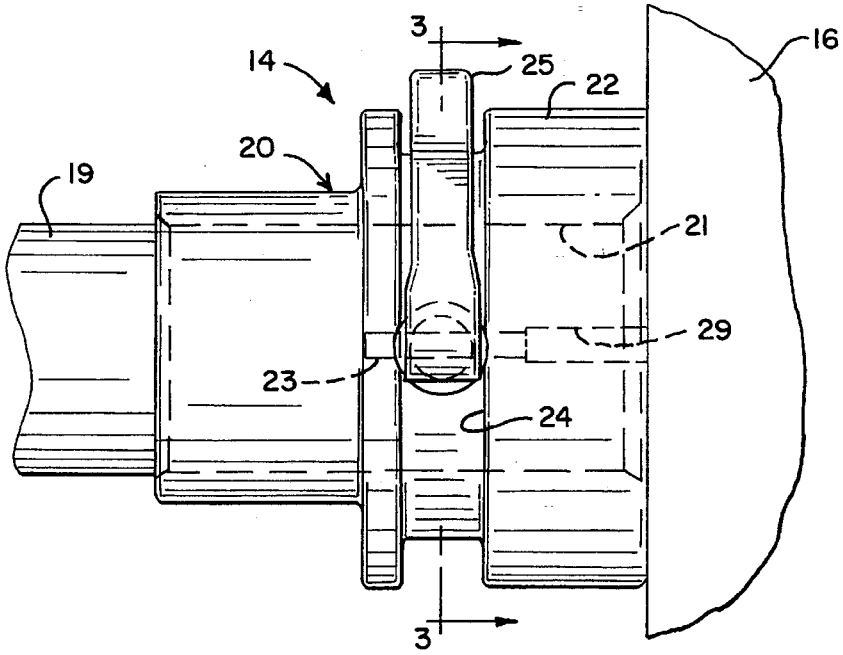
FIG. 2 is a top plan view of the collar assembly on the bar as depicted in FIG. 1.

FIG. 2 further illustrates the collar assembly 14. The assembly includes a generally annular collar or sleeve 20 defining a bore 21 so that the assembly can be slid along the sleeve 19. The collar 14 has a flange 22 with an indentation 24 to accommodate a cam handle 25. The collar assembly 14 is placed snugly against the weight 16 before the cam handle 25 is placed in the locked position.

Figure 3:
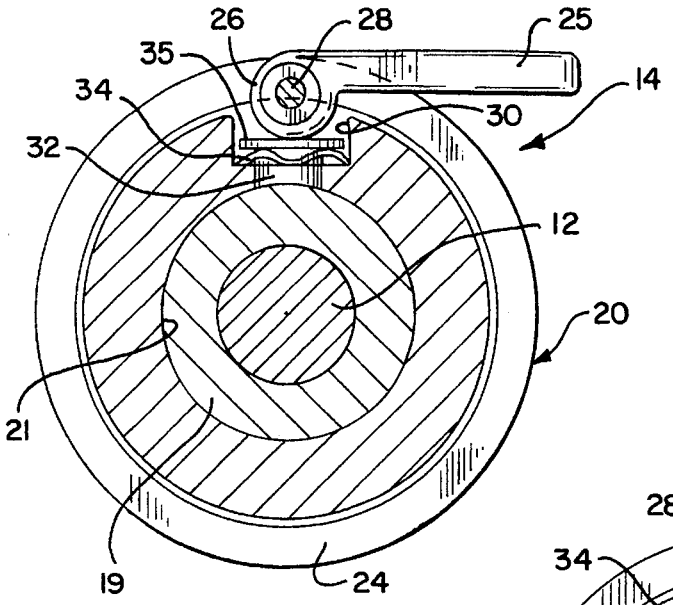
FIG. 3 is a cut away view of the collar assembly depicted in FIG. 2 taken generally along line 3—3 of FIG. 2 wherein a cam of the assembly is in a locked position.

Referring to FIG. 3, the cam handle 25 operates an integral cam 26 pivotally affixed to the collar 20 by a pin 28. The pin can be surrounded by a resilient bushing, as illustrated, made of neoprene or other lightweight, relatively frictionless material so that the cam rotates easily about the pin. A passage 29 (FIG. 2) in the collar facilitates press-fitting of the pin 28 in position to retain the cam and its handle for pivotal movement. The cam 26 is rotated between the locked position (FIG. 3) and the unlocked position (FIG. 4), or vice-versa, using handle 25.

A portion of the cam 26 is disposed in a radially extending passage 30 which communicates with the bore 21 through the collar 14. Operatively interposed between the cam 26 and the sleeve 19 on bar 12, which is inserted through the bore 21, is a lock shoe 32. The lock shoe 32, as depicted in FIG. 3, is urged against the bar 12 disposed in the bore 21 when the cam 26 is in the locked position. A spring 34 is held in captive relation between an enlarged head portion 35 of the lock shoe 32 and relatively narrow portion of the passage 30. Although the spring 34 is depicted as a spring-type washer, the spring can alternatively be a washer made of a resilient material such a rubber. The spring can alternatively be a coil spring or the like, as long as it is sufficiently resilient to urge the lock shoe away from engagement with the bar 12 or the sleeve 19 when the cam 26 is in the unlocked position, yet does not create undue resistance to movement of the lock shoe 32 when the cam 26 is moved into its locked position.

Figure 4:
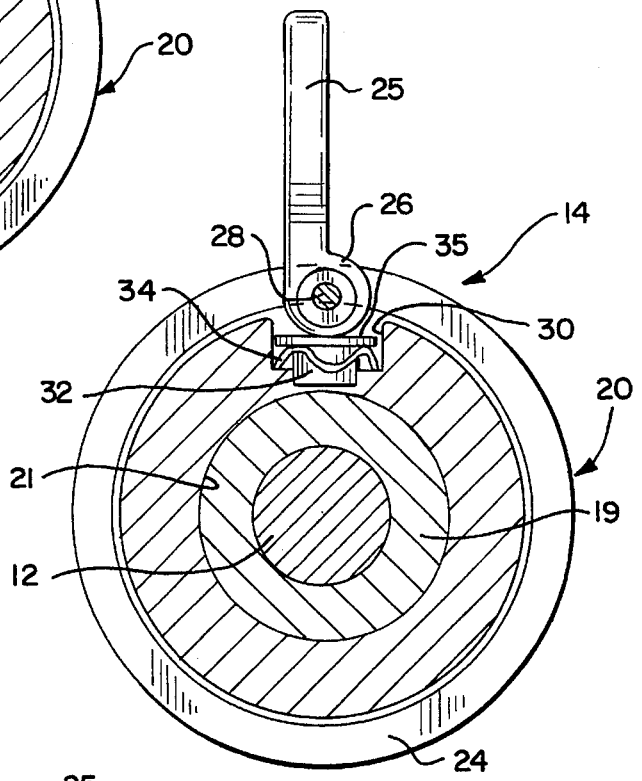
FIG. 4 is a view similar to FIG. 3 with the cam in an unlocked position.

FIG. 4 depicts the cam 26 in its unlocked position. In the unlocked position the resilient spring 34 exerts sufficient force to urge the enlarged head portion of the lock shoe 32 away from the bar 12 in the bore 21 so that the collar assembly can be easily slid along the shaft.

The cam 26 is configured for overcenter locking cooperation with the lock shoe 32 in the locked position of the cam. That is, the portion of cam 26 spaced most radially outwardly from the pin 28 moves through and past a "center" position defined by a line from the pin 28 along the axis of movement of lock shoe 32 when the cam is moved into its locked position. Thus, forces acting radially outwardly on the lock shoe 32, and against the cam 26, act to maintain the cam 26 in its locked position, thereby assuring stability of the collar assembly.

Figure 5:
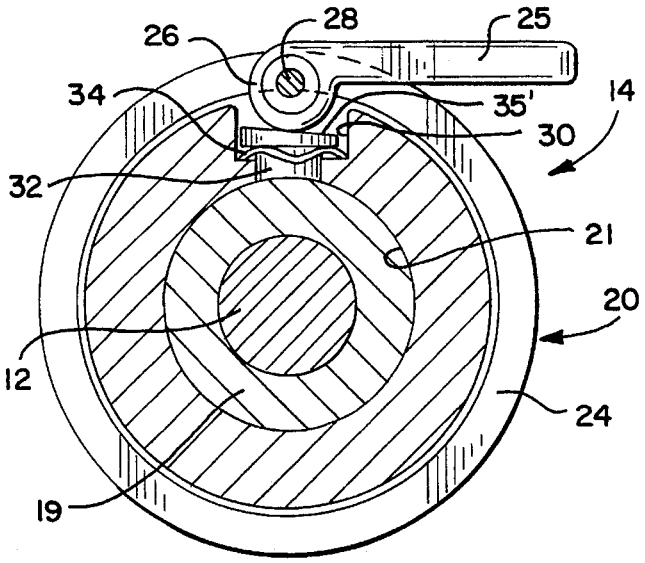
FIG. 5 is a view similar to FIG. 3 illustrating a modified embodiment of the collar in accordance with the present invention.
Figure 6:
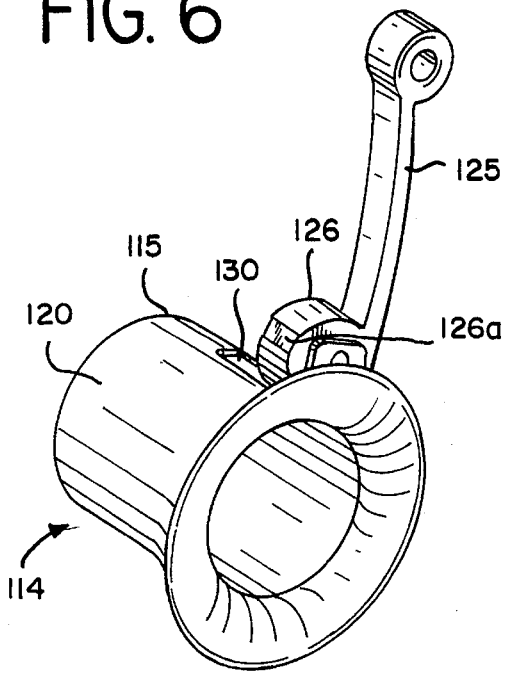
FIG. 6 is a perspective view of an alternative embodiment of a quick release collar assembly incorporating the present invention.

FIG. 5 illustrates a modified embodiment in which the enlarged head portion 35' of the lock shoe 32' is cut on a bias or angled. This acts to reduce the range of motion of the cam 26, and to increase the depth of penetration of the lock shoe 32'.

It will be appreciated by one skilled in the art that the cam and the lock shoe can be in operative association in a number of orientations. In the embodiment depicted herein the cam operates directly over the lock shoe with the cam lever operating in a plane essentially perpendicular to the line defined by the bar axis. The cam can be oriented in a variety of positions as dictated by the design and application of the collar assembly and yet not deviate from the concept of the invention if the cam and lock shoe are in operative association as generally disclosed herein. Furthermore, the handle 25, while illustrated as being straight, may be suitably bent to facilitate gripping and pivotal manipulation thereof between its locked and unlocked positions.

Similarly, the collar bore 21 depicted in the embodiment herein is essentially perpendicular to the passage 30 with the lock shoe 32 disposed therein. It will be appreciated by one skilled in the art that the bore and passage can intersect at a variety of angles as long as the lock shoe in the passage can engage the bar with sufficient force to retain the collar on the bar when the cam is in the locked position.

FIGS. 6–9 illustrate an alternative embodiment of a collar assembly 114 embodying the present invention. The collar assembly 114 includes a collar 115 adapted to be attached to a weight bar 119. The collar 115 has a generally cylindrical body portion 120 defining a generally axial bore 121 for insertion onto the bar 119, and an enlarged flared flange 122 at one end thereof. The flange 122 is placed snugly against weights positioned on the bar 119 as shown in FIG. 1.

An opening 130 is formed in the cylindrical body 120 of the collar 115. A pair of ears or pivot supports 131 extend radially outwardly from the surface of the body 120 adjacent the opening 130 for pivotally supporting a locking cam portion 126 formed integrally with cam arm 125. The cam portion 126 includes a bore **126*a* to receive a pivot shaft 128 which is pivotally supported in the pivot supports 131. The pivot shaft 128 is encased in a resilient bushing 129**, made, for example, of Neoprene.

Figure 7:
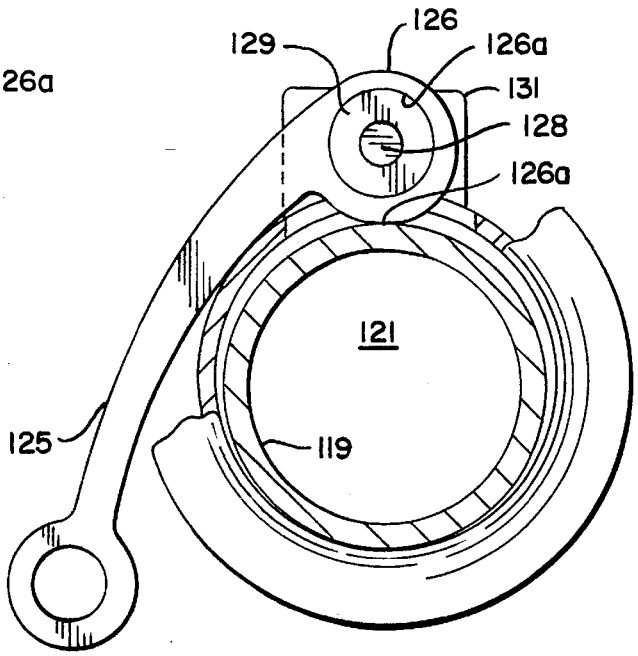
FIG. 7 is an end view, partially cut away view of the collar assembly depicted in FIG. 6 showing the cam arm in locked position.
Figure 8:
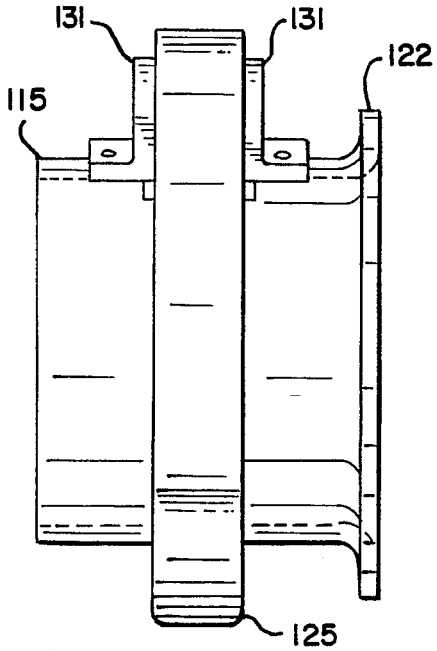
FIG. 8 is an side elevation view, the collar assembly depicted in FIG. 7.
Figure 9:
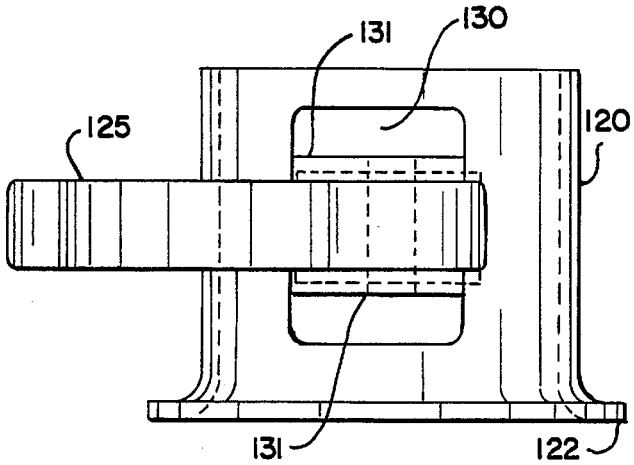
FIG. 9 is a top plan view, the collar assembly depicted in FIG. 7.

The locking cam portion 126 is eccentric about the axis of the pivot shaft 128. The outer portion of the locking cam 126 is reduced in size or truncated to minimize engagement of the cam 126 with the weight bar 119 during the initial rotation of the locking assembly from the open position shown in FIG. 6 into the closed position as shown in FIG. 7. A detent **126*a* formed in the surface of the cam 126 engages the curved, convex surface of the weight bar to facilitate holding the cam in place. The maximum dimension of the cam is immediately adjacent to the detent 126*a* which is in an over center position to further retain the cam 126** in the locking position and resist loosening of the locking assembly.

Thus during initial rotation of the locking assembly arm 125 and cam 126 from the open to the locking position, the shape of the cam minimizes initial engagement between the cam and the bar. As the cam and arm continue to rotate, the surface of the cam 126 engages the curved surface of the weight bar. The cam and arm are rotated past the point of maximum cam dimension to position the detent 126 against the weight bar. At the point of maximum cam dimension, the resilient bushing is compressed to allow movement of the cam into the locking position in spite of the engagement of the hard surfaces of the cam and weight bar without undue resistance.

From the foregoing, it will be observed that numerous modifications and variations can be effected without departing from the true spirit and scope of the novel concept of the present invention. It is to be understood that no limitation with respect to the specific embodiments illustrated is intended or should be inferred. It is, of course, intended to cover by the appended claims all such modifications as fall within the scope of the claims.

What is claimed is:

1. A quick-release retaining collar assembly for a barbell comprising:

a generally annular collar, the collar defining a bore adapted to receive an associated bar;

said collar further defining an opening that communicates with the bore;

a pivot member connected to said collar;

a locking assembly including a cam member movably connected to said pivot member, said cam member being movable on said pivot member generally in a plane transverse to the axis of said bore between an unlocked position and a locked position, and being effective in the locked position to lock the locking assembly to retain the collar on the bar and resist movement relative to the bar; and a sleeve made of resilient material on said pivot member interposed between said pivot member and said cam member said resilient sleeve being compressed as said cam member is moved into the locked position.

2. The quick-release collar of claim 1 wherein the resilient material is a lightweight, relatively frictionless material.

3. The quick-release collar of claim 2 wherein the resilient material is a polymeric material.

4. The quick-release collar of claim 3 wherein the resilient material is made of Neoprene.

5. The quick-release collar of claim 1 wherein said cam member is in overcenter locking cooperation with the bar in the locked position.

6. The quick-release collar of claim 1 wherein said pivot member lies along an axis generally parallel to and offset from the axis of said bore.

7. The quick-release collar of claim 6 wherein said cam member is pivotally mounted on said pivot member, and said cam member rotates around said offset axis between the unlocked position and the locked position.

* * * * *